US006902651B2

(12) United States Patent
Fujiki et al.

(10) Patent No.: US 6,902,651 B2
(45) Date of Patent: Jun. 7, 2005

(54) TUBE BANK STRUCTURE, AND FLOW TUBE PRODUCING METHOD

(75) Inventors: Keiichi Fujiki, Mihara (JP); Tetsuo Makino, Mihara (JP); Akimine Izawa, Mihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 14 days.

(21) Appl. No.: 10/275,962

(22) PCT Filed: Mar. 15, 2002

(86) PCT No.: PCT/JP02/02492

§ 371 (c)(1),
(2), (4) Date: May 27, 2003

(87) PCT Pub. No.: WO02/077363

PCT Pub. Date: Oct. 3, 2002

(65) Prior Publication Data

US 2003/0178167 A1 Sep. 25, 2003

(30) Foreign Application Priority Data

Mar. 19, 2001 (JP) ..... 2001-78374

(51) Int. Cl.[7] ..... D21F 1/00

(52) U.S. Cl. ..... 162/343; 72/370.23; 72/370.24; 72/370.26

(58) Field of Search ..... 162/343; 72/370.23, 72/370.24, 370.26

(56) References Cited

U.S. PATENT DOCUMENTS

| | | | | | |
|---|---|---|---|---|---|
| 3,400,044 | A | * | 9/1968 | Justus | 162/343 |
| 3,514,372 | A | | 5/1970 | Boyce et al. | |
| 3,652,392 | A | * | 3/1972 | Appel | 162/343 |
| 4,146,427 | A | * | 3/1979 | Hogel et al. | 162/343 |
| 4,455,197 | A | | 6/1984 | Croteau et al. | |
| 5,183,537 | A | * | 2/1993 | Hergert et al. | 162/216 |
| 5,196,091 | A | * | 3/1993 | Hergert | 162/258 |

FOREIGN PATENT DOCUMENTS

| | | |
|---|---|---|
| DE | 35 25 760 A1 | 2/1986 |
| DE | 199 37 302 A | 2/2001 |
| WO | WO 93/07335 | 4/1993 |

* cited by examiner

*Primary Examiner*—Peter Chin
(74) *Attorney, Agent, or Firm*—Armstrong, Kratz, Quintos, Hanson & Brooks, LLP

(57) ABSTRACT

The invention provides tube bank structure and a method of manufacturing a flow tube, which can improve the stabilization of the flow of stock in the tube bank of the headbox of a papermaking machine and prevent the development of turbulence and uneven concentration of stock flow by a simple and inexpensive means, resulting in speedup of papermaking process. Said flow tubes has a smaller diameter pipe portion of a circular cross-section in the inlet side, a larger diameter pipe portion connected to said smaller diameter pipe portion, a tapered pipe portion, and a rectangular pipe portion, the cross-sectional configuration of said tapered pipe portion being changed smoothly from circular to rectangular configuration.

9 Claims, 6 Drawing Sheets

9
23
B2
B1
25
2
22
A
21
D2
D1
210
d
24
L0
L1
L2
L3
121

TUBE BANK STRUCTURE, AND FLOW TUBE PRODUCING METHOD

FIELD OF THE INVENTION

The present invention relates to the tube bank structure composing the headbox of a paper-making machine provided with a plurality of flow tubes inside which flows raw material of paper (stock) and a method of manufacturing said flow tubes.

TECHNICAL BACKGROUNDD

A large number of flow tubes which raw material of paper (stock) flows through are arranged in the tube bank of the headbox of a papermaking machine for stabilizing the flow therethrough of stock and conducting it to nozzles provided at downstream portion of the tubes. The stabilized flow of the stock at the outlet of the tube bank is important and a variety of arts are put into practice to improve the stabilizing effect in the tube bank to suppress turbulent flow of the stock at the outlet of the tube bank as the machine becomes increasingly faster.

One of improved arts is disclosed in Japanese Patent Publication No.6-506274, the front view of the tube bank of which is shown in FIG. 7.

In this invention, a plurality of flow tubes 2 arranged in the tube bank of the headbox of the papermaking machine are formed such that the inlet side portion of circular cross-section of each flow tube is joined to a larger diameter circular pipe portion of a diameter larger than that of said inlet side portion and the larger diameter circular pipe portion is succeeded by a portion of which the configuration of cross-section is smoothly changed to a rectangular section at the outlet opening end while maintaining the circumferential length constant.

In the invention of Japanese Patent Application Publication No.56-148990, a plurality of flow tubes, each tube being formed such that the inlet side cross-section is of circular configuration and the configuration of section changes smoothly while increasing in cross-sectional area to a rectangular configuration at the outlet opening end, are arranged such that said outlet opening ends are aligned in staggered arrangement.

However, there are problems in said prior arts as follows:

In the invention of Japanese Patent Publication 6-506274, the flow tube 2 is formed such that the circular inlet side portion is joined to a larger diameter circular pipe portion of a diameter larger than that of said inlet side portion and the larger diameter circular pipe portion is succeeded by a portion of which the configuration of cross-section is smoothly changed to a rectangular section at the outlet opening end and a plurality of the flow tubes are arranged such that the rectangular outlet opening ends are aligned in a vertical direction, so that the center distance between adjacent rectangular outlet opening ends in the vertical direction is defined by the outer diameter of said larger diameter circular pipe portion. Therefore, there is formed between adjacent outlet opening ends a rand S of large width corresponding to the length (diameter of said larger diameter pipe portion−width(shorter side) of the rectangle of outlet opening end+2 times of wall thickness of the flow tube 2).

As the rands S are formed on the rectangular outlet end parts of the flow tubes in the prior art as mentioned above, turbulence of large size is developed immediately downstream relative to the rectangular outlet end parts. To prevent the development of turbulence, a flow seat is provided for stabilizing the flow of stock immediately downstream relative to each rectangular opening end, which results in complicated structure and poor maintainability because of the necessity of removing the flow seat when performing maintenance servicing.

In the invention of Japanese Patent Publication No.56-148990, each of the flow tubes is formed such that it is increased in diameter from the inlet opening end toward the outlet opening end and the inlet end of each of the inlet opening end is welded to a plate while aligning a plurality of the flow tubes, so the manufacturing cost of the flow tube bank is increased. Further, to complement the reduction in dispersion effect because of the absence of a stepped part, the length of the flow tube is formed to be very long, which may induce to the development of concentration streak after the stock flow outflows the flow tube. To prevent the development of concentration streak, the rectangular outlet openings of a plurality of said flow tubes are aligned in staggered arrangement. Therefore, flow tubes different in shape and cross-sectional area are to be located in both ends in the direction of width of the tube arrangement. As a result, dispersion and flow rate in the center part are different from those in the both end parts of the flow passage.

SUMMARY OF THE INVENTION

The present invention was made in light of the problems in prior arts, the object is to provide a tube bank structure in which stabilization of the flow of stock in the tube bank is improved by a simple and inexpensive means and the development of turbulence and uneven concentration of stock flow is prevented, resulting in speedup of the papermaking machine, and a method of manufacturing the flow tube thereof.

To solve the problems, the present invention proposes the tube bank structure of the headbox of a papermaking machine having a plurality of flow tubes for flowing raw material of paper (stock) arranged in the tube bank, wherein each of said flow tubes has a smaller diameter pipe portion of a circular cross-sectional configuration in the upstream side defining an inlet opening for the stock, and a larger-diameter flow tube portion, the larger diameter flow tube portion consisting of a larger diameter pipe portion of a diameter larger than that of said smaller diameter pipe portion and connected to said smaller diameter pipe portion, a succeeding tapered pipe portion changing smoothly in sectional configuration from circular one to rectangular one toward downstream to be enlarged smoothly in cross-sectional area to be succeeded by a rectangular pipe portion defining an outlet opening for the stock.

It is suitable to form each of said flow tube such that the larger diameter flow tube portions is formed such that the upstream side end of the tapered pipe has a circular cross-section of the diameter the same as that of said larger diameter pipe portion and its downstream side end has a rectangular cross-section the same as that of said rectangular pipe portion, and further shorter sides, i.e. width ($B_1$) of said rectangular pipe portion is larger than the outer diameter ($D_1$) of said larger diameter pipe portion.

Each of said larger diameter flow tube portions is shaped from a single seamless pipe.

Further, it is suitable that a plurality of said flow tubes are arranged in said tube bank such that the outlet opening ends are arranged like in an array of cells so as not to form a gap between adjacent opening ends in a vertical direction.

Further, it is suitable that a plurality of said flow tubes are arranged in said tube bank such that the outlet opening ends are arranged like in an array of cells so as not to form a gap between adjacent opening ends in a horizontal direction. For example, a plurality of said flow tubes are arranged in said tube bank such that the outlet opening ends are arranged like in an array of cells so as not to form a gap between adjacent opening ends in a horizontal direction, in a vertical direction a dove-tail plate is located in each gap between adjacent outlet opening ends, and a flow seat is possible to be anchored to the dove-tail plate to be extended downstream therefrom.

It is suitable that the outlet opening end of each of said flow tubes is directly opened toward downstream passage defining a nozzle part without the medium of a flow seat.

The method of manufacturing a flow tube for flowing raw material of paper (stock), a plurality of said flow tubes being to be arranged in the tube bank of the headbox of a papermaking machine, each of said flow tubes having a smaller diameter pipe portion of a circular cross-section in the upstream side and a larger diameter flow tube portion extending downstream therefrom consisting of a larger diameter pipe portion, a tapered pipe portion, and a rectangular pipe portion, is characterized in that said larger diameter flow tube portion is shaped by forming a single pipe into a semi-processed pipe having a larger diameter portion corresponding to the larger diameter pipe portion, an expanding tapered portion, and an expanded diameter portion in continuation, and then pressing said expanded tapered portion and said expanded diameter portion in a radial direction to form the expanding tapered portion into the tapered pipe portion changing in cross-sectional configuration smoothly from circular one to rectangular one and the expanded diameter portion into the rectangular pipe portion.

It is suitable in this case that said semi-processed pipe is formed by expanding a single circular pipe of the diameter corresponding to that of the larger diameter pipe portion to have said circular pipe diameter portion, an expanding tapered portion, and an expanded diameter portion in continuity, or by rotary swaging a single circular pipe of the diameter corresponding to that of the expanded diameter portion to have the expanded diameter portion, the tapered portion, and the larger diameter portion corresponding to the larger diameter pipe portion in continuity.

According to the invention, the flow of the stock changed in flow direction by about 90° when it is introduced into the smaller diameter pipe portion becomes symmetric in velocity distribution with respect to the center line of the flow tube during it flows in the smaller diameter pipe portion. The flow is disturbed when it passes the stepped part at the connecting part of the smaller diameter pipe portion with the larger diameter pipe portion, where the dispersion of fibers is improved by the disturbance. Further, the flow of the stock is stabilized as it flows through the larger diameter pipe section and through the tapered pipe portion where the flow passage is formed so that flow separation does not occur.

Further, by defining the total length of said larger diameter pipe portion, tapered pipe portion, and rectangular pipe portion ($L_1+L_2+L_3$) to be within $3.5D_2$~$7D_2$ in relation to the inner diameter of the larger diameter pipe $D_2$, the flow from each individual tube is stabilized enough with proper turbulence remained and uneven concentration does not develop in the downstream flow. Therefore, it becomes possible to arrange the flow tubes such that the outlet opening ends are arranged like in an array of cells without forming a gap between each of the flow tubes in both vertical and horizontal directions.

Further, since the flow tubes are arranged such that the outlet end of each rectangular pipe portion is arranged like in an array of cells in a vertical and horizontal directions without forming a gap between each flow tube as described above, the width of the rand between each opening end is minimum as is only two times the thickness of the tube wall. Therefore, the turbulence in the flow of the stock at the outlet openings is largely suppressed compared with the case of the conventional art in which a gap between the adjacent outlet openings of rectangular pipe portions is formed.

Further, by arranging the outlet ends of said flow tubes like in an array of cells, the outlet ends of the same configuration are located all over the width of the outlet of the tube bank, so the flow of the stock with uniform dispersion of fibers all over the flow passage downstream from the outlet can be achieved.

Therefore, according to the present invention, a flow seat is not required to be provided immediately downstream relative to each outlet opening end of rectangular configuration for stabilizing the flow as is in the case of said prior art, resulting in simplified construction and improved maintainability of the papermaking machine due to the elimination of said flow seat.

Further, in the present invention, it is possible also to comply with the property peculiar to the kind of paper to be made, for example, with low value of the ratio of tensile strength in the flow direction to that in the direction perpendicular thereto (in width direction), etc. by providing the dove-tail plate to anchor the flow seat in the gap formed between each opening end of each flow tube in a vertical direction.

Further, according to the present invention, a single pipe is formed into a semi-processed pipe having a larger diameter portion, an expanding tapered portion, and an expanded diameter portion, and then the larger diameter flow tube portion with cross-sectional configuration smoothly changing from the circular configuration in the inlet side toward the rectangular configuration in the outlet side can be obtained only by pressing the linearly expanded tapered portion and the expanded diameter portion in a radial direction. Therefore, the larger diameter flow tube portion can be manufactured easily without welding process as was in the case of a conventional art, resulting in the reduction of the number of manufacturing hours.

BRIEF DESCRIPTION OF THE DRAWINGS

FIG. 1(A) is a front view, and FIG. 1(B) is a view in the direction of arrow A in FIG. 1(A).

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
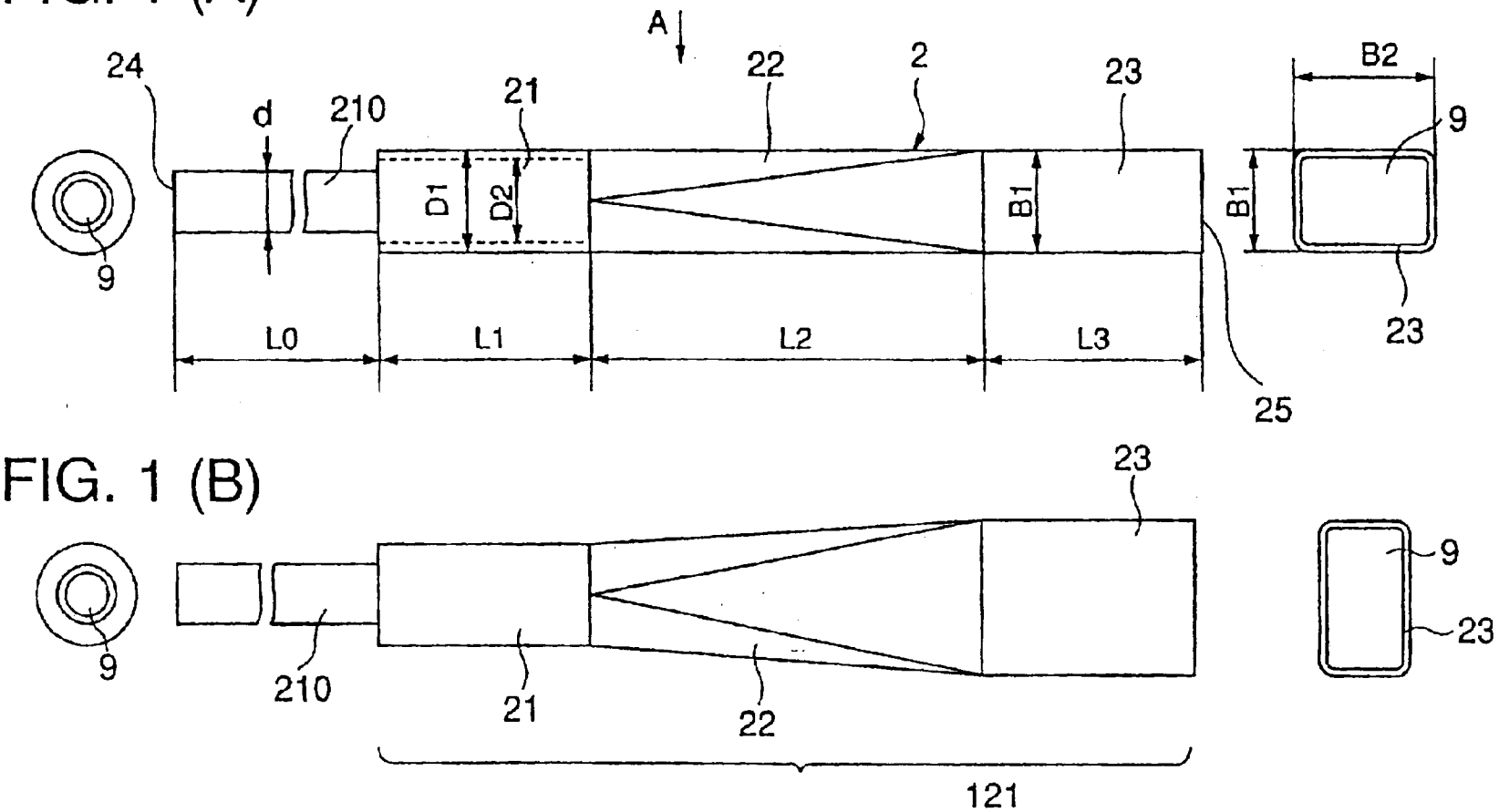
FIG. 1 is an illustration showing the structure of a flow tube attached to the tube bank of the headbox of the papermaking machine according to the present invention.
Figure 2:
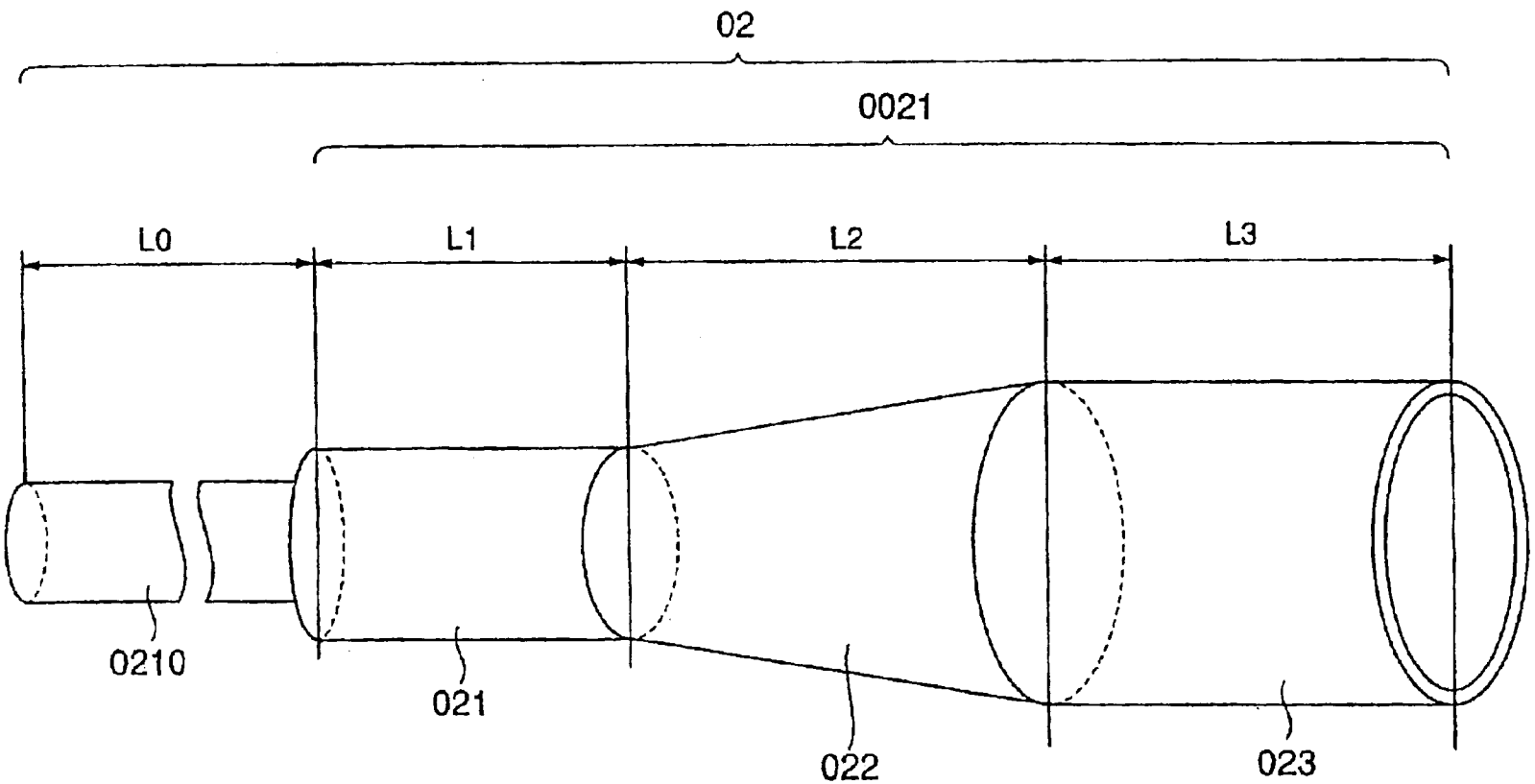
FIG. 2 is an illustration for explaining the method of manufacturing the flow tube.
Figure 3:
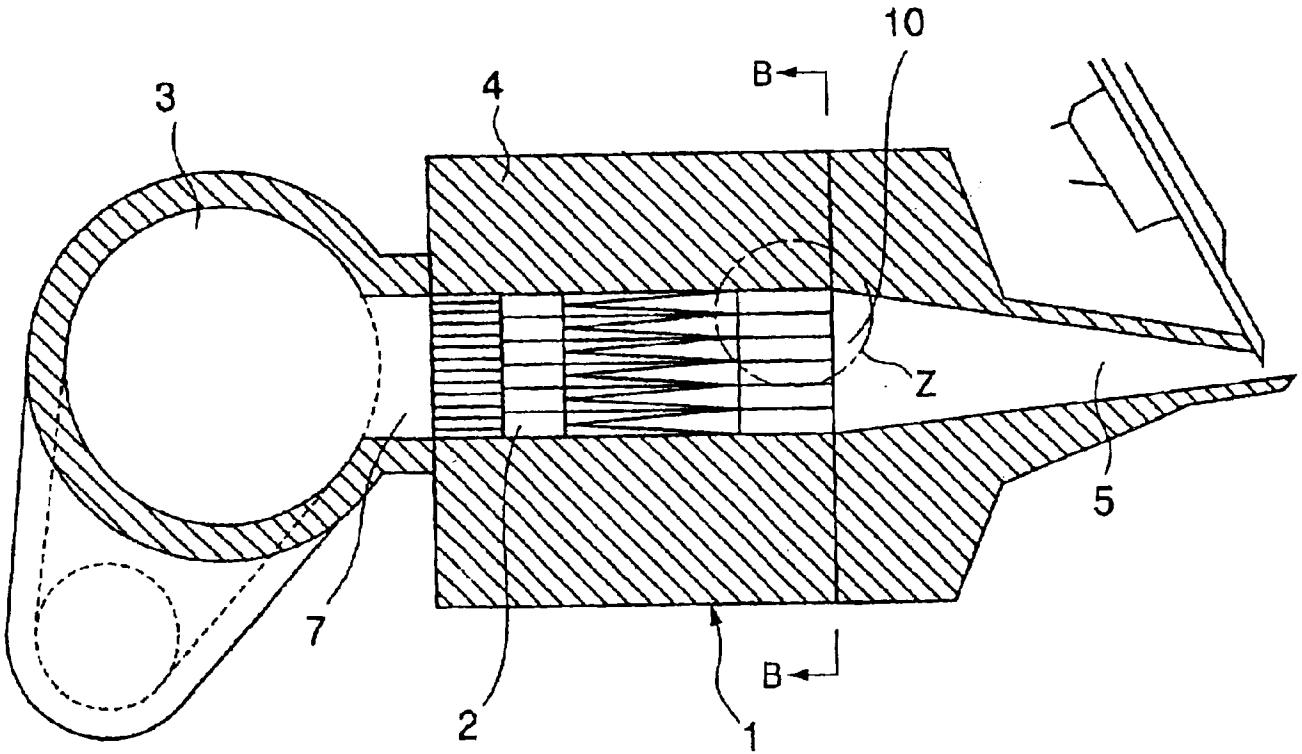
FIG. 3 is a schematic sectional view near the tube bank of the headbox.
Figure 4:
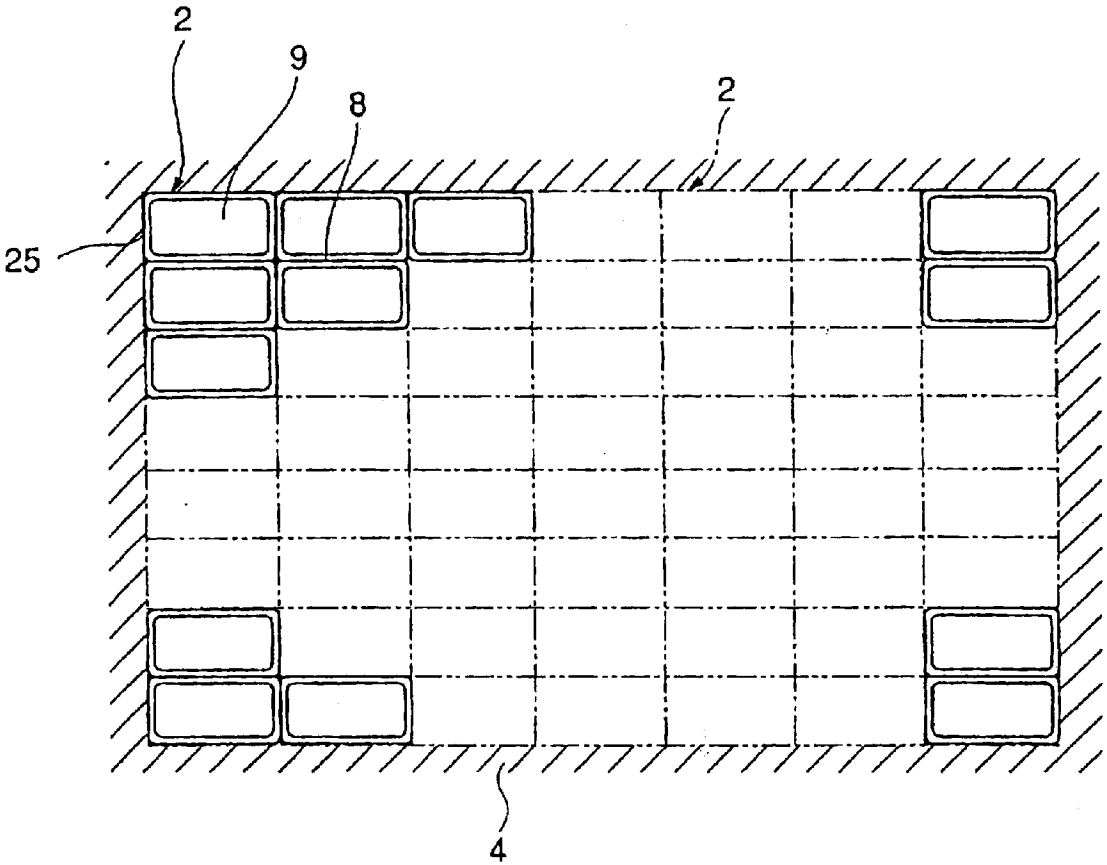
FIG. 4 is a view in the direction of arrows B—B in FIG. 3.
Figure 5:
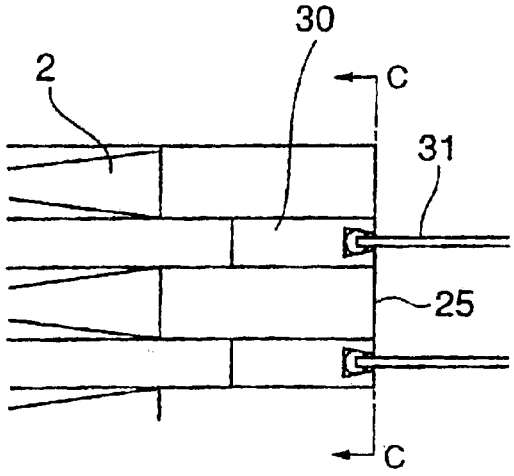
FIG. 5 is an enlarged partial cutaway view of the encircled part Z in FIG. 3 in the case of a second embodiment.
Figure 6:
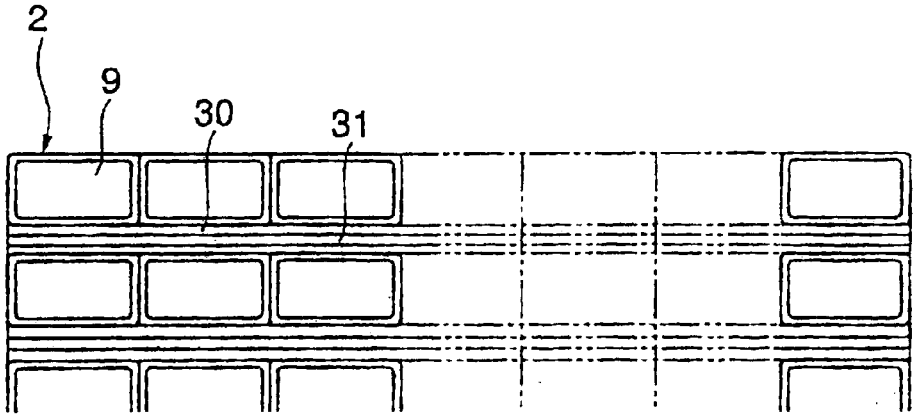
FIG. 6 is a view in the direction of arrows C—C in FIG. 5.
Figure 7:
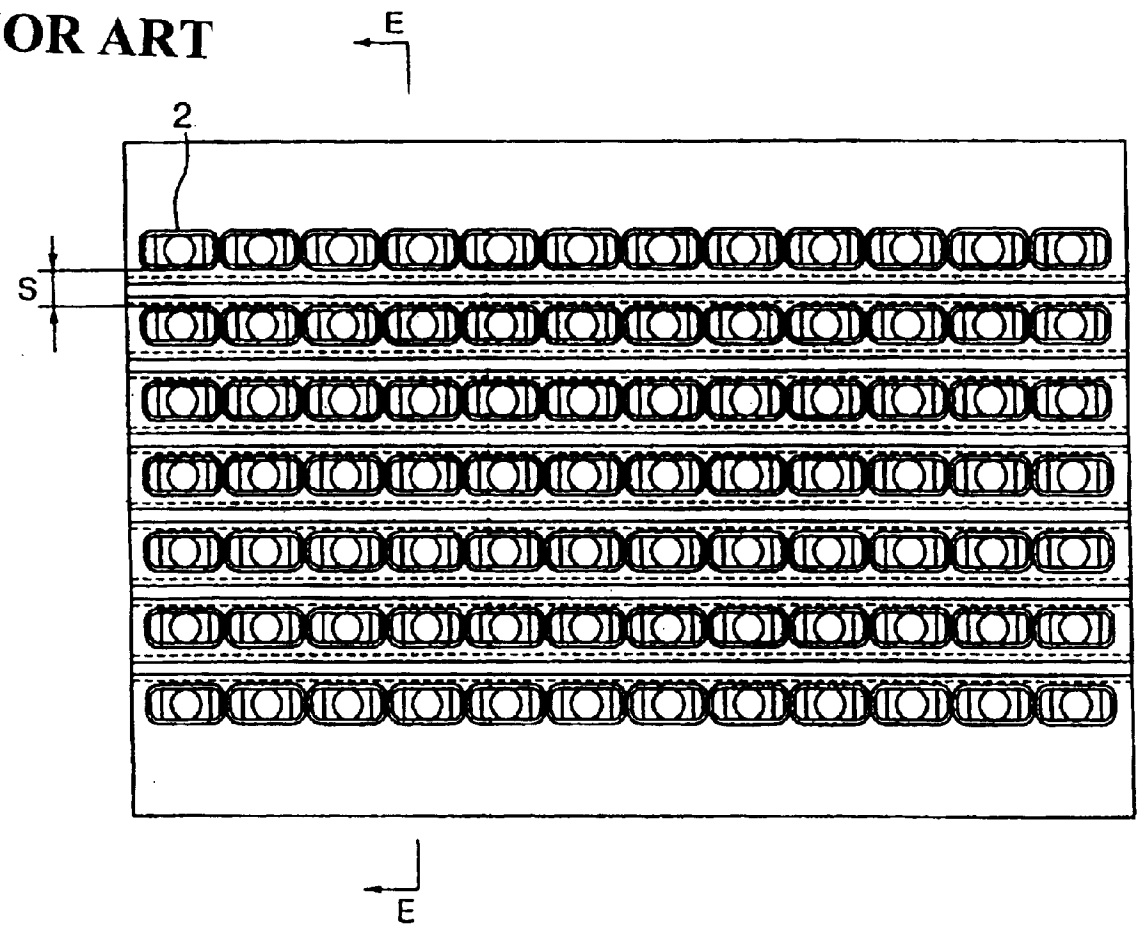
FIG. 7 PRIOR ART
FIG. 7 is a front view showing the arrangement of output opening ends of flow tubes of a conventional art.

FIG. 1 is an illustration showing the structure of a flow tube attached to the tube bank of the headbox of the papermaking machine according to the present invention, FIG. 1(A) is a front view, and FIG. 1(B) is a view in the direction of arrow A in FIG. 1(A). FIG. 2 is an illustration for explaining the method of manufacturing said flow tube. FIG. 3 is a schematic sectional view near the tube bank of the headbox, and FIG. 4 is a view in the direction of arrows B—B in FIG. 3. FIG. 5 is an enlarged partial cutaway view of the encircled part Z in FIG. 3 in the case of a second embodiment, and FIG. 6 is a view in the direction of arrows C—C in FIG. 5.

Referring to FIG. 3 showing a section near the tube bank of the headbox to which the present invention is applied, reference numeral 1 is a tube bank, 3 is a tapered pipe-like header connected to said tube bank at upstream side, 7 is a tube inlet passage for allowing raw material of paper (stock) to flow into said tube bank, and 4 is a tube bank casing. Reference numeral 2 indicates a plurality of flow tubes arranged in said tube bank casing 4 and will be detailed later. Reference numeral 5 is a nozzle part connected to the outlet passage 10 of the tube bank 1.

Said plurality of flow tubes 2 are arranged in the casing 4 of the tube bank 1 such that the outlet opening ends 25 are arranged like in an array of cells without forming a gap between each of the flow tubes 2 in both vertical and horizontal directions as shown in FIG. 4. The outlet passage 10 of said tube bank 1 is, as shown in FIG. 3, opened directly to the downstream passage including said nozzle part 5 without a medium for flow stabilization such as flow seats, etc.

Referring to FIG. 1 showing the detail of the flow tube 2, the flow tube 2 consists of a smaller diameter pipe portion 210 of length $L_0$ being circular in sectional configuration and defining an inlet opening 24 for introducing the stock, a larger diameter portion 21 of length $L_1$ larger in diameter than said smaller diameter pipe portion 210 connected therewith, a rectangular pipe portion 23 of length $L_3$ being rectangular in sectional configuration and defining the outlet opening 25, and a tapered pipe portion 22 of length $L_2$ of which the portion is expanded in the downstream direction to be connected with said larger diameter pipe portion 21 and said rectangular pipe portion 23, the larger diameter pipe portion 21, tapered pipe portion 22, and rectangular pipe portion 23 being denoted together as a larger diameter flow tube portion 121.

The larger diameter flow tube portion 121 is shaped from a single seamless pipe made of a corrosion-resistant material such as stainless steel pipe. At the connection of said smaller diameter pipe portion 210 with said larger diameter pipe portion 21 is formed a stepped part. Reference number 9 is a flow passage formed inside the flow tube 2.

The upstream end of said tapered pipe portion 22 is formed in a circular configuration of a diameter same as that of said larger diameter pipe portion 21 to be connected smoothly therewith, and the downstream end thereof is formed in a rectangular configuration same as that of said rectangular pipe portion 23 to be connected smoothly therewith. In the embodiment shown in FIG. 1(A), the shorter side $B_1$ of said rectangular pipe portion 23, the outer diameter $D_1$ of said larger diameter pipe portion 21, and the height (vertical width in the drawing) of said tapered pipe portion 22 are about the same, and the tapered pipe portion 22 is expanded in a horizontal direction. More specifically, the shorter side $B_1$ of said rectangular pipe portion 23 is formed a little larger than the outer diameter $D_1$ of said larger diameter pipe portion 21.

The length $L_1$, $L_2$, and $L_3$ of said larger diameter pipe portion 21, tapered pipe portion 22, and rectangular pipe portion 23 respectively, which constitute a stabilizing portion of the flow of the stock flowing through said passage 9 in the flow tubes 2, are determined in relation to the inner diameter of the larger diameter pipe portion $D_2$ as follows:

$$L_1+L_2+L_3=(3.5\sim7)\times D_2 \quad (1)$$

By determining like this, the flow of the stock is sufficiently stabilized in each of the flow tubes 2, and unevenness in the concentration of the stock does not occur in the flow after the flow tube 2 due to proper turbulence.

Therefore, it is allowed to arrange a plurality of said flow tubes 2 in the casing 4 of the tube bank 1 such that the outlet openings 25 are arranged in an array of cells without forming gaps between each wall of the flow tubes 2 in a vertical plane perpendicular to the longitudinal direction of the flow tubes, and thus the turbulence induced by the mixing of the raw material of paper flowing out from the flow tubes 2 can be suppressed.

Next, the method of manufacturing said flow tube 2 is explained referring to FIG. 2. A pipe of diameter which is the same as that of said larger diameter pipe portion 21 is formed into a semi-processed pipe 0021 of larger diameter flow tube portion having a larger diameter portion of length $L_1$, an expanding tapered portion 022 of length $L_2$ expanded in diameter along the length $L_2$ which corresponds to said tapered pipe portion 22, and an expanded diameter portion 023 of length $L_3$ which corresponds to said rectangular pipe portion 23 by expanding the diameter according to each portion.

Then, the semi-processed pipe 0021 is pressed to change sectional configuration such that the expanding tapered portion 022 is deformed from immediately downstream part of the larger diameter portion 021 along the length $L_2$ to smoothly change the shape of section from a circular configuration which is the same as that of the larger diameter pipe portion 21 into the rectangular configuration which is the same as that of the rectangular pipe portion 23 and to change the expanded portion 023 from a circular sectional configuration into a rectangular sectional configuration which is the same as that of the rectangular pipe portion 23. Then the smaller diameter portion 0210 of length $L_0$ corresponding to said smaller diameter pipe portion 210 is welded to the larger diameter portion 021.

By this method, a single pipe is formed into the semi-processed pipe 0021 of larger diameter flow tube portion having a larger diameter portion 021 corresponding to the larger diameter pipe portion 21, a linearly expanded tapered portion 022 corresponding to the tapered pipe portion 22, and an expanded diameter portion 023 corresponding to the rectangular pipe portion 23 by expanding the diameter in accordance with each portion, then the larger diameter flow tube portion 121 can be obtained only by pressing the expanding tapered portion 022 and the expanded diameter portion 023 in a radial direction. Therefore, the larger diameter flow tube portion 121 can be manufactured easily without welding process resulting in the reduction of the number of manufacturing hours.

In the headbox of the papermaking machine provided with the tube bank as described above, the stock introduced into said tube bank 1 via said header 3 and inlet passage 7 enters the smaller diameter pipe portion 210 of each flow tube 2 as shown in FIG. 3.

The flow of the stock changed in direction by about 90° when it is introduced to the inlet passage 7 to flow through the smaller diameter pipe portion 210 is perfectly directed in the machine direction during it flows in the pipe portion 210 and the flow velocity distribution in the pipe portion 210 becomes symmetric with respect to the center line of the flow tube.

The flow is disturbed at the stepped part where the cross-sectional area abruptly changes from that of the smaller diameter pipe portion 210 to that of the larger diameter pipe portion 21, stress loss is induced, the flocculation of fibers is destroyed, and dispersion of fibers is improved. As the stock flows through the tapered pipe portion 22 where the flow passage is defined so that flow separation does not occur and through the rectangular pipe portion 23, the turbulence induced at said stepped part is lowered, i.e. the flow is stabilized. On the other hand, if the lengths $L_1$, $L_2$, and $L_3$ are too long, the flow becomes excessively stabilized and uneven fiber concentration is produced in the tube resulting in the development of concentration streaks even after the stock flowed out from the flow tube 2. Therefore, by determining the length of the larger diameter flow tube portion 121 to be long enough for stabilizing the turbulence induced at the stepped part and at the same time to be of the length with which the concentration streaks does not develop in the downstream flow, that is, to be in the range determined by the equation (1), the flow is stabilized and the development of concentration streaks in the downstream flow is prevented.

A plurality of the flow tubes 2 arranged in the casing 4 of the tube bank 1 are arranged such that the outlet opening ends 25 of the rectangular pipe portions 23 are arranged like in an array of cells without forming a gap between each of the flow tubes in both vertical and horizontal directions as shown in FIG. 4, so that the width of the rand 8 at the outlet opening end 25 is only two times the thickness of the flow tube 2. Therefore, the turbulence of the flow of stock at the outlet of the flow tube 2 is largely decreased compared with the case of the invention of Japanese patent Publication 6-506274, in which there is a clearance between adjacent outlet opening ends of rectangular configuration.

Therefore, according to the embodiment, a flow seat is not required to be provided immediately downstream relative to each outlet opening end of rectangular configuration for stabilizing the flow as is in the case of said prior art, resulting in simplified construction and improved maintainability of the papermaking machine due to the elimination of said flow seat.

In the second embodiment shown in FIG. 5 and FIG. 6, a plurality of said flow tubes 2 are arranged such that the outlet opening ends 25 of the rectangular pipe portions 23 are arranged like in an array of cells without forming a gap between each of the flow tubes in a horizontal direction and a dove-tail plate 30 is provided in the clearance formed between adjacent outlet opening ends 25 in a vertical direction, a flow seat 31 being possible to be anchored to the dove-tail plate 30 to be extended downstream therefrom.

According to the embodiment, by providing the dove-tail plate 30 to anchor the flow seat 31 in the clearance formed as small as possible between each opening end 25 of each flow tube 2 in a vertical direction, it is possible to comply with the property peculiar to the kind of paper to be made, for example, with low value of the ratio of tensile strength in the flow direction to that in the direction perpendicular thereto (in width direction), etc.

INDUSTRIAL APPLICABILITY

As has been described in the foregoing, according to the present invention, the flow of the stock changed in flow direction by about 90° when it is introduced to the smaller diameter pipe portion 210 is perfectly directed in the machine direction during it flows in the pipe portion 210 and the flow velocity distribution in the pipe portion 210 becomes symmetric with respect to the center line of the flow tube. The flow is disturbed when it passes the stepped part at the connecting part of the smaller diameter pipe portion with the larger diameter pipe portion, where the dispersion of fibers is improved by the disturbance. The flow of the stock is stabilized as it flows through the tapered pipe portion where the flow passage is formed so that flow separation does not occur and through the rectangular pipe portion.

Further, by defining the total length of said larger diameter pipe portion, tapered pipe portion, and rectangular pipe portion ($L_1+L_2+L_3$) to be within $3.5D_2 \sim 7D_2$ in relation to the inner diameter of the larger diameter pipe $D_2$, the flow from each individual tube is stabilized enough with proper turbulence remained and uneven concentration does not develop in the downstream flow. Therefore, it becomes possible to arrange the flow tubes such that the outlet opening ends are arranged like in an array of cells without forming a gap between each of the flow tubes in both vertical and horizontal directions. The outlet ends of the same configuration are located all over the width of the tube bank by the arrangement of the outlet ends of the flow tubes like in an array of cell's, so the flow of the stock with uniform dispersion of fibers all over the width of the flow passage downstream from the outlet can be achieved.

Further, since the flow tubes are arranged such that the outlet ends of rectangular pipe portions are arranged like in an array of cells in a vertical and horizontal directions without forming a gap between adjacent opening ends, the width of the rand between adjacent opening ends is minimum as is only two times the thickness of the tube wall. Therefore, the turbulence in the flow of the stock at the outlet openings is largely suppressed compared with the case of the conventional art in which a clearance is formed between adjacent outlet openings of rectangular pipe portions.

Therefore, according to the present invention, a flow seat is not required to be provided immediately downstream relative to each outlet opening end of rectangular configuration for stabilizing the flow as is in the case of said prior art, resulting in simplified construction and improved maintainability of the papermaking machine due to the elimination of said flow seat.

Further, in the present invention, it is possible to comply with the property peculiar to the kind of paper to be made, for example, with low value of the ratio of tensile strength in the flow direction to that in the direction perpendicular thereto (in width direction), etc., by providing the dove-tail plate to anchor the flow seat in the clearance formed as small as possible between adjacent opening ends of flow tubes in a vertical direction.

Further, according to the present invention, a single pipe is formed into a semi-processed pipe having a larger diameter portion, an expanding tapered portion, and an expanded diameter portion, and then the larger diameter flow tube portion having a tapered pipe portion with cross-sectional configuration smoothly changing from the circular configuration in the inlet side to the rectangular configuration in the outlet side can be obtained only by pressing the expanding tapered portion and the expanded diameter portion in a radial direction. Therefore, the larger diameter flow tube portion can be manufactured easily without welding process resulting in the reduction of the number of manufacturing hours.

To sum up, according to the present invention, the stabilization of the flow of stock in the tube bank is improved by a simple and inexpensive means, and the development of turbulence and uneven concentration of stock flow is prevented, resulting in speedup of papermaking process.

What is claimed is:

1. Tube bank structure of the headbox of a papermaking machine having a plurality of flow tubes for flowing raw material of paper (stock) arranged in the tube bank, wherein each of said flow tubes has a smaller diameter pipe portion of a circular cross-sectional configuration in the upstream side defining an inlet opening for the stock, and a larger diameter flow tube portion, the larger diameter flow tube portion consisting of a larger diameter pipe portion, having a length $L_1$ and an inner diameter $D_2$, of a diameter larger than that of said smaller diameter pipe portion and connected to said smaller diameter pipe portion, a succeeding tapered pipe portion, having a length $L_2$, changing smoothly in sectional configuration from circular one to rectangular one toward downstream to be enlarged smoothly in cross-sectional area to be succeeded by a rectangular pipe portion, having a length $L_3$, defining an outlet opening for the stock, wherein $$L_1+L_2+L_3=(3.5\sim7)\times D_2.$$

2. The tube bank structure according to claim 1, wherein each of said larger diameter flow tube portions is formed such that the upstream side end of the tapered pipe has a circular cross-section of the diameter the same as that of said larger diameter pipe portion and its downstream side end has a rectangular cross-section the same as that of said rectangular pipe portion, and shorter sides, i.e. width ($B_1$) of said rectangular pipe portion is larger than the outer diameter ($D_1$) of said larger diameter pipe portion.

3. The tube bank structure according to claim 1, wherein each of said larger diameter-flow tube portions is shaped from a single seamless pipe.

4. The tube bank structure according to claim 1, wherein a plurality of said flow tubes are arranged in said tube bank such that the outlet opening ends are arranged like in an array of cells so as not to form a gap between adjacent opening ends in a vertical direction.

5. The tube bank structure according to claim 1, wherein a plurality of said flow tubes are arranged in said tube bank such that the outlet opening ends are arranged like in an array of cells so as not to form a gap between adjacent opening ends in a horizontal direction.

6. The tube bank structure according to claim 1, wherein the outlet opening end of each of said flow tubes is directly opened toward downstream passage defining a nozzle part without the medium of a flow seat.

7. The tube bank structure according to claim 1, wherein a plurality of said flow tubes arranged in said tube bank such that the outlet opening ends are arranged like in an array of cells so as not to form a gap between adjacent opening ends in a horizontal direction, in a vertical direction a dove-tail plate is located in each gap between adjacent outlet opening ends, and a flow seat is possible to be anchored to the dove-tail plate to be extended downstream therefrom.

8. A flow tube producing method for flowing raw material of paper (stock), a plurality of said flow tubes being to be arranged in the tube bank of the headbox of a papermaking machine, each of said flow tubes having a smaller diameter pipe portion of a circular cross-section in the upstream side and a larger diameter flow tube portion extending downstream therefrom consisting of a larger diameter pipe portion, having a length L, and an inner diameter $D_2$, a tapered pipe portion, having a length $L_2$, and a rectangular pipe portion, wherein said larger diameter flow tube portion is shaped by forming a single pipe into a semi-processed pipe having a larger diameter portion corresponding to the larger diameter pipe portion, an expanding tapered portion, and an expanded diameter portion in continuation, and then pressing said expanded tapered portion and said expanded diameter portion in a radial direction to form the expanding tapered portion into the tapered pipe portion changing in cross-sectional configuration smoothly from circular one to rectangular one and the expanded diameter portion into the rectangular pipe portion having a length $L_3$, and wherein $L_1+L_2+L_3=(3.5\ 7)\times D_2$.

9. The flow tube producing method according to claim 8, wherein said semi-processed pipe is formed by expanding a single circular pipe of the diameter corresponding to that of the larger diameter pipe portion to have said circular pipe diameter portion, an expanding tapered portion, and an expanded diameter portion in continuity, or by rotary swaging a single circular pipe of the diameter corresponding to that of the expanded diameter portion to have the expanded diameter portion, the tapered portion, and the larger diameter portion corresponding to the larger diameter pipe portion in continuity.

* * * * *